US005564207A

United States Patent [19]

Wagner

[11] Patent Number: 5,564,207

[45] Date of Patent: Oct. 15, 1996

[54] PLACARD FOR CURVED OBJECTS

[75] Inventor: Paul F. Wagner, Houston, Tex.

[73] Assignee: Flora International Corp., Houston, Tex.

[21] Appl. No.: 196,304

[22] Filed: Feb. 15, 1994

[51] Int. Cl.[6] ..... G09F 1/06

[52] U.S. Cl. ..... 40/124.1; 40/308

[58] Field of Search ..... 40/308, 539, 124.1, 40/124.4; 446/147, 148

[56] References Cited

U.S. PATENT DOCUMENTS

| | | | |
|---|---|---|---|
| 2,142,547 | 1/1939 | Anderson | 40/539 |
| 2,441,333 | 5/1948 | Reinsberg | 446/147 X |
| 4,319,418 | 3/1982 | Transport | 446/148 X |

FOREIGN PATENT DOCUMENTS

| | | | |
|---|---|---|---|
| 740547 | 1/1933 | France | 40/539 |
| 1384877 | 11/1964 | France | 446/147 |
| 11092 | 3/1906 | United Kingdom | 40/539 |

*Primary Examiner*—Joanne Silbermann
*Attorney, Agent, or Firm*—Arnold White & Durkee

[57] ABSTRACT

A placard for a curved object made from a sheet of material having first and second continuous edges and slits extending across a portion of the sheet. The continuous edges of the sheet may be brought together to form a flexible base for a placard that may be affixed to a curved object, such as a basket handle.

1 Claim, 8 Drawing Sheets

PLACARD FOR CURVED OBJECTS

The present invention relates to a placard for curved objects and, more particularly, to a placard for use with baskets having curved handles.

Gifts, foodstuffs, and other materials are often stored or shipped in baskets and other like containers. These baskets and containers often have curved handles for ease of portability. The shape of the curved handle and its traditional location at the top of the container render it difficult to place notices or placards containing contents information or gift greetings directly on the top of the container where they would be most visible.

In an effort to place highly visible notices or placards on baskets and containers with curved handles, several approaches have been advanced. In a first approach, placards or notices were affixed to the lower base of the container or basket. This position is not believed to be the optimum location for such notices. In a second approach cards containing contents or gift greeting information were simply inserted into the basket or the container along with the contents thereof. In this approach, the cards often shift during transportation and become obstructed by the contents of the basket or container. Neither of the approaches discussed above allows for the positioning of placards or notices in the position of greatest visibility.

It is an object of the present invention to provide a placard that may be affixed to curved objects so as to allow for enhanced visibility of the contents of the placard. It is a further object of the present invention to provide a placard that may be affixed to the handle of a basket for enhancing the visibility of contents or gift greeting information printed on the placard. A still further object of the present invention is to provide a placard for curved objects that is relatively easy to manufacture, ship, store, display and assemble.

It is a further object of this invention to provide a flexible placard for curved objects where test, graphics and other printing on the placard is not significantly distorted upon assembly of the placard.

SUMMARY OF THE INVENTION

The present invention is believed to overcome the problems of the prior art by providing a placard for a curved object that is relatively easy to manufacture, ship, store and assemble.

In one embodiment of the present invention spaced slits are made on a flat sheet of material upon which is printed container contents or gift greetings information. Opposing edges of the flat sheet are brought together to form a flexible base for a placard that may be affixed to a curved object, such as a basket handle.

In another embodiment of the present invention, spaced slits are made on a sheet of material upon which is printed container contents or gift greeting information. One edge of the sheet is configured to form a flexible base that may be affixed to the top of a curved object, such as a basket handle.

In still another embodiment a flexible placard is formed from a flexible channel that is capable of receiving cutouts, letters photographs or the like.

BRIEF DESCRIPTION OF THE DRAWINGS

The subject matter which is regarded as the present invention is particularly pointed out and distinctly claimed in the final portion of this specification. Certain aspects of the invention, however, may be better understood by reference to the accompanying figures in which:

FIGS. 9A–9C illustrate a flexible channel for receiving cutouts, photographs and the like.

DETAILED DESCRIPTION OF THE INVENTION

Figure 1A:
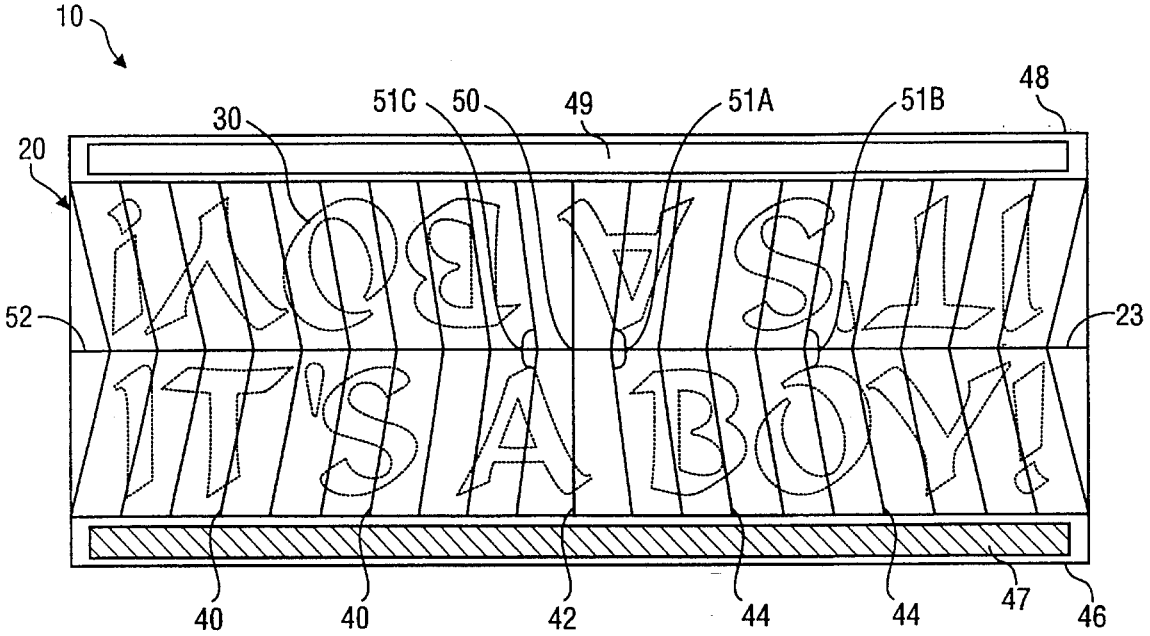
FIGS. 1A and 1B illustrate a flexible placard of the present invention.

Referring to the figures where like numerals indicate like elements throughout and particularly to FIG. 1A a placard 10 for a curved object is shown. The placard consists of a flat sheet of material 20. Material 20 may be any material but is preferably cardboard, paperboard, plastic, paper, foam or the like. Material 20 should be sufficiently rigid to avoid distorting when the placard 10 is assembled. Forty point pressboard has been found to be an acceptable material. In one embodiment of the invention, information 30 is printed on one side of the sheet of material 20. The printed information may consist of text or figures related to the contents of the container upon which the placard will be placed (e.g., the name and a figure of the fruit, nuts or other items to be placed in the container), In another embodiment, the printed information 30 consists of a gift greeting (e.g., Happy Birthday, It's a Boy!) for use with gift baskets or the like. Still further embodiments are envisioned where the printed matter consists of a picture, figure or ornamental design with or without decorative text.

Figure 2A:
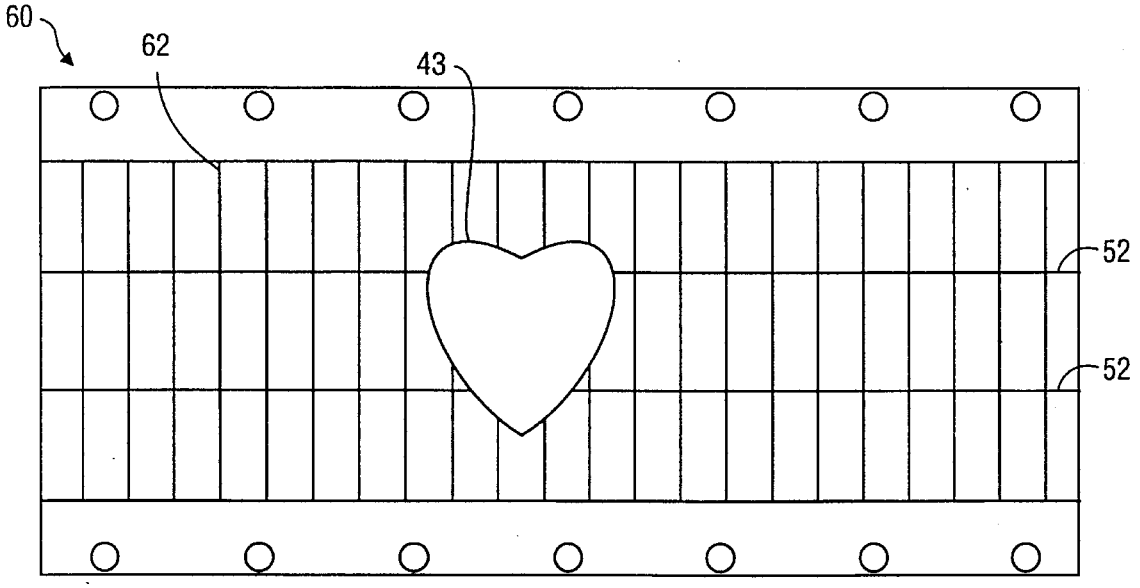
FIGS. 2A–4 illustrate alternate embodiments of the flexible placard of the present invention.

Portions of the sheet have been removed or punched to define spaced slits 40, 42 and 44 extend across the sheet of material 20. The spaced slits 40, 42 and 44 may be formed after the printed information 30 is applied to the material 20. Preferable the distances between the slits along an imaginary centerline 23 running across the sheet is the same. As illustrated in FIG. 1A, the spaced slits 40, 42 and 44 preferably do not extend across the entire length of the sheet of material 20, such that continuous edges 46 and 48 are established along two sides of sheet 20. Alternate embodiment are envisioned where cutouts are made in the sheet when the slits are made. This embodiment is illustrated in FIG. 2A, are formed along with cutout 43. The cutout may be any desired shape and may include printing defining a decorative item or a message.

Referring back to FIG. 1A, the particular spacing and arrangement of the slits 40, 42 and 44 should be such that a flexible placard is formed when the continuous edges 46 and 48 are brought together. One such spacing and arrangement of slits 40, 42 and 44 is illustrated in FIG. 1A. In this embodiment of the invention, the slits are substantially "V" shaped with the direction of the "V" reversing at the midpoint 50 of sheet 20 to form a first group of slits 40 angled in one direction and a second group of slits 44 angled in a second direction. Each V shaped slit spans and angle 51. In this embodiment the slit 42 corresponding to the midpoint 50 of sheet 20 is essentially a straight slit formed from one of the continuous edges 46 to the other 48. It may be desirable to increase the angle spanned by the V shaped slits 51 as the slits approach the midpoint 50 of sheet 20. For example, in the embodiment illustrated in FIG. 1A, the angle 51*a* spanned by a V shaped slit at a location relatively near midpoint 50 is greater than the angle 51*b* spanned by a slit at a location relatively distant from midpoint 50. Preferably the angular span of the slits is symmetrical about midpoint 50 such that the width 51*a* is equal to width 51*c*.

In one embodiment a serration 52 is formed from one end of the sheet 20 to the other so that a fold may be more easily made along the serration.

Figure 3A:
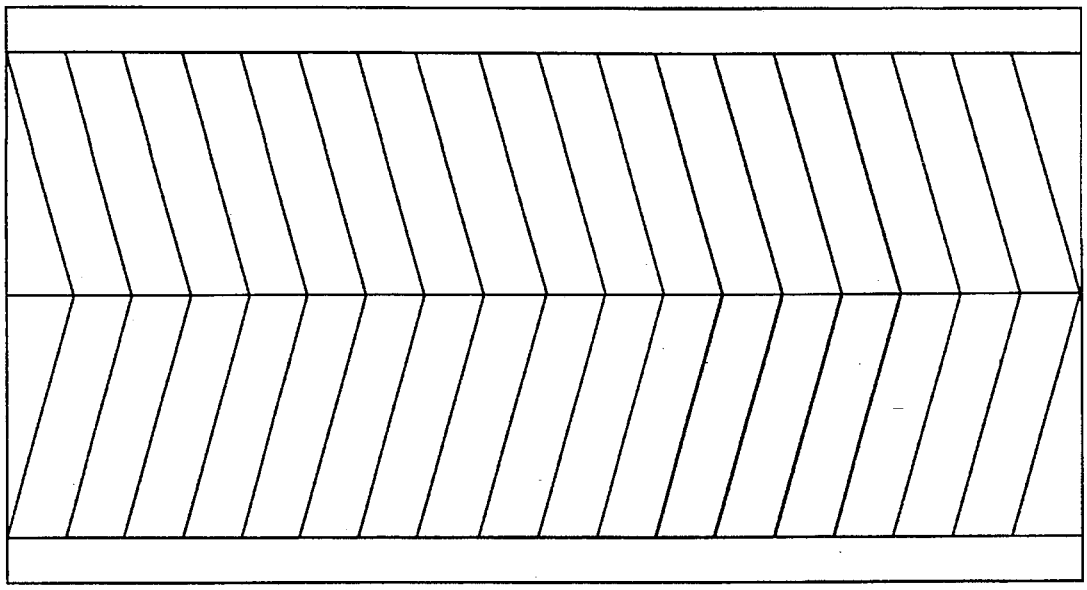
Figure 4:
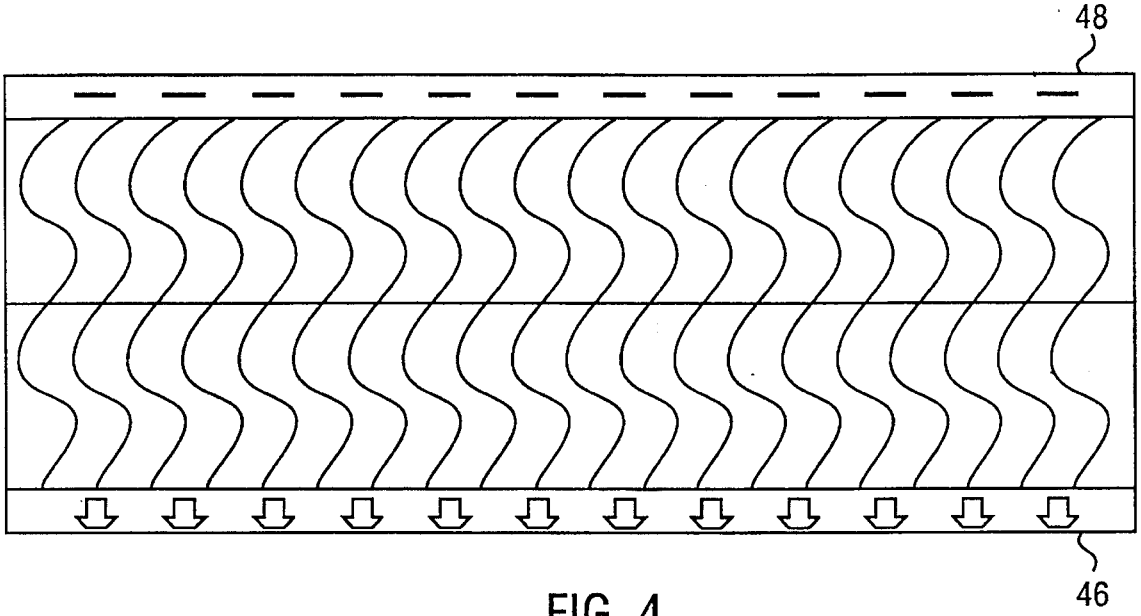

Other patterns of slits are envisioned. For example, FIG. 2A illustrates an alternate embodiment 60 where substantially straight spaced slits 62 are formed across the sheet. In this embodiment two serrations 52' may be formed along the sheet to aid folding of the sheet. Still further patterns for the spaced slits are illustrated in FIG. 3A and 4. In FIG. 3A the spaced slits are substantially V shaped, where all of the V shaped slits are formed in the same direction. FIG. 4 illustrated an embodiment where the spaced slits are substantially S shaped. Other arrangements are envisioned and will be apparent to those skilled in the art with the benefit of this disclosure.

Referring back to FIG. 1A, a first layer of adhesive 47 may be placed along one of the continuous edges 46. The adhesive 47 should be such that edge 46 will adhere to edge 48 when the edges are brought together. Adhesive 47 may be permanent two sided tape, such as two-sided polyester adhesive tape. A second layer of adhesive 49 may be formed along the other edge of the sheet 20. Adhesive 49 should be such that edge 46 will adhere to the basket or container upon which flexible placard 10 will be placed. When placard 10 will be used with a wicker basket or the like, a strip of adhesive material, such as adhesive foam, may be used in place of adhesive 49.

Alternate embodiments are envisioned where adhesive 49 is eliminated and holes are formed along the continuous edges 46 and 48. This alternate embodiment is illustrated in FIG. 2A. In FIG. 2A, holes are formed in the edges 46 and 48 of the placard 10. To assemble the placard of this embodiment, continuous edges 46 and 48 are brought together string or ribbon is threaded through the holes. As still further embodiment is illustrated in FIG. 4. In this embodiments, tabs are formed in continuous edge 46 and receiving slits are formed in edge 48. The slits are configured to receive the tabs so that continuous edge 46 and 48 may be affixed without any form of adhesive. Still further arrangements are envisioned where no adhesive, holes or tabs are applied or formed along the continuous edges. In this embodiment the user of the placard can affix edge 46 to edge 48 through any suitable method (e.g., by stapling or gluing edge 46 to edge 48).

Figure 5:
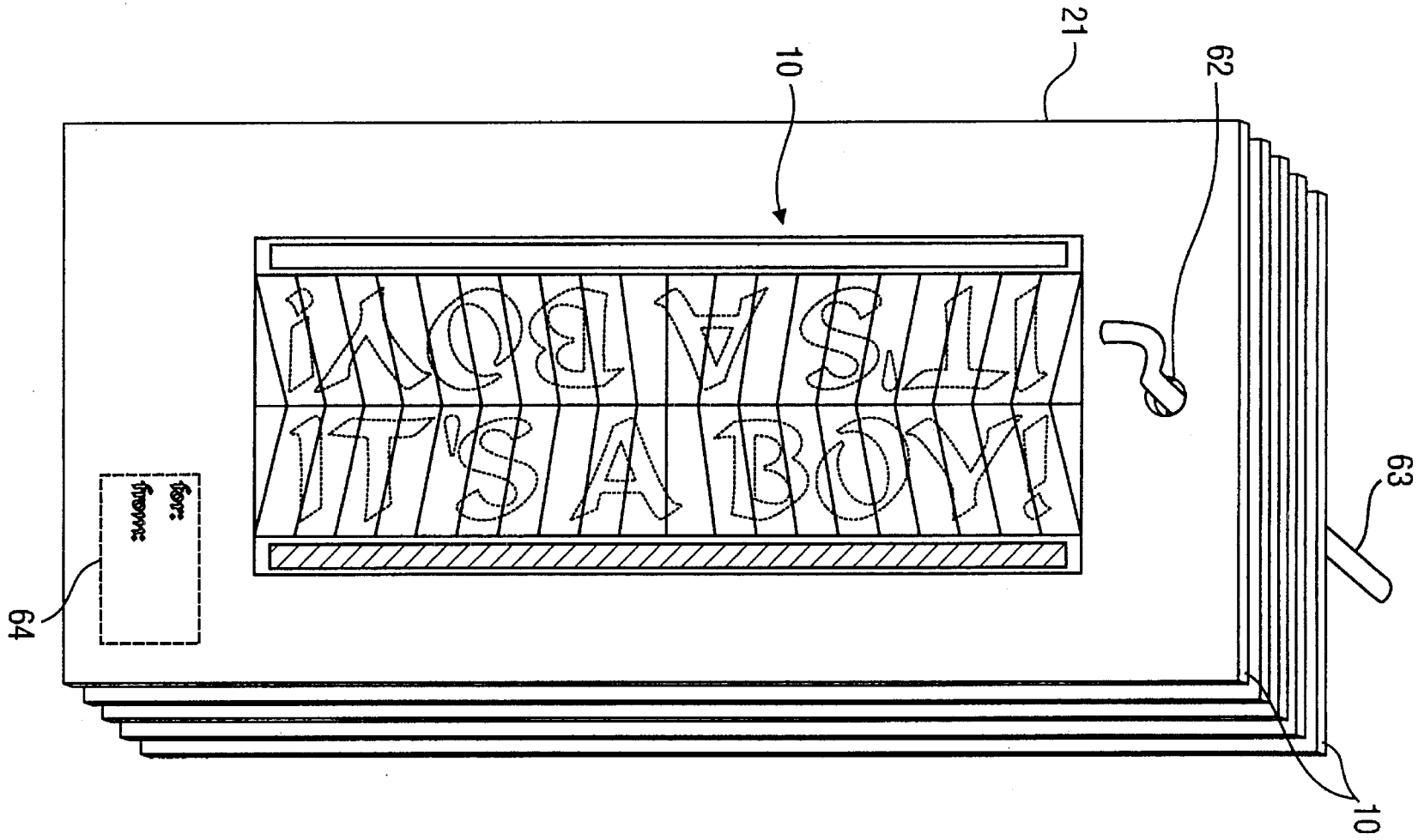
FIG. 5 illustrates the display of the placard of the present invention.

As may be noted, the unassembled flexible placard 10 of the present invention comprises a single sheet of material 20. This allows for a large number of placards 10 to be efficiently stacked and/or packed into boxes for shipping and storage. Further, the flat, unassembled, nature of the present invention allows for efficient display of the placards 10. For example, the sheet 20 may be formed from a larger sheet 21, as illustrated in FIG. 5. In this embodiment a hole 62 may be formed at one end of sheet 21 so that a plurality of placards 10 may be stored on an extending hook 63. In this embodiment a gift card 64 may be cut into the opposite end of sheet 21 to identify the recipient of the basket or container on which the placard 10 will be placed.

As the preceding makes clear, the placard 10 of the present invention allows for an efficient manufacturing procedure. First, printed information 30 is placed on the sheet of material 21. Because of the nature of the present invention, the information 30 needs to be placed on only one side of material 21 allowing for a fast and economical printing procedure. Arrangements are envisioned, however where both sides of material 21 will receive printing. For example, one side of material 21 could receive printed matter, such as text or decorative figures, and the other side could be printed with a pattern of solid color to enhance the appearance of the placard when it is assembled. After any printing is placed on sheet 21, slits are formed in the sheet (e.g., by punching) to form the placard 10, the gift card 54, if used, and the slits 40, 42 and 44 across the placard. If hole or tabs and receiving slits are used to affix the continuous edged, they may be formed at this time. After the slits are formed the adhesive, if used, may be applied to the continuous edged. The cut, unassembled sheet 21 may then be wrapped for shipping and display as illustrated in FIG. 5.

Figure 1B:
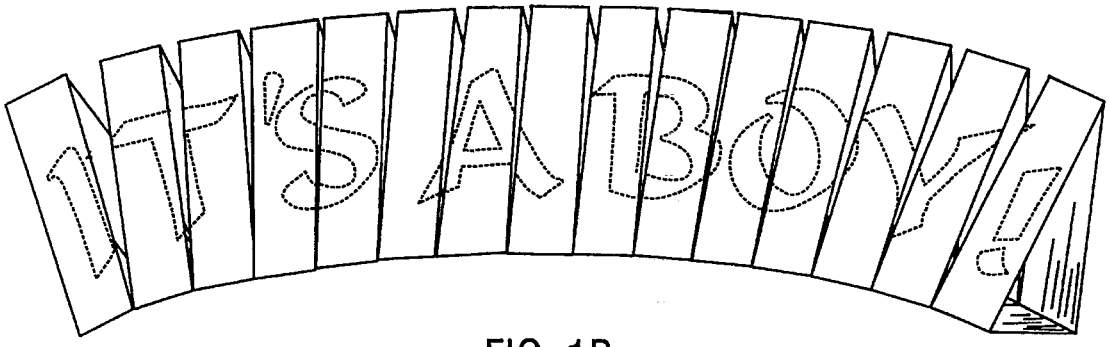
Figure 2B:
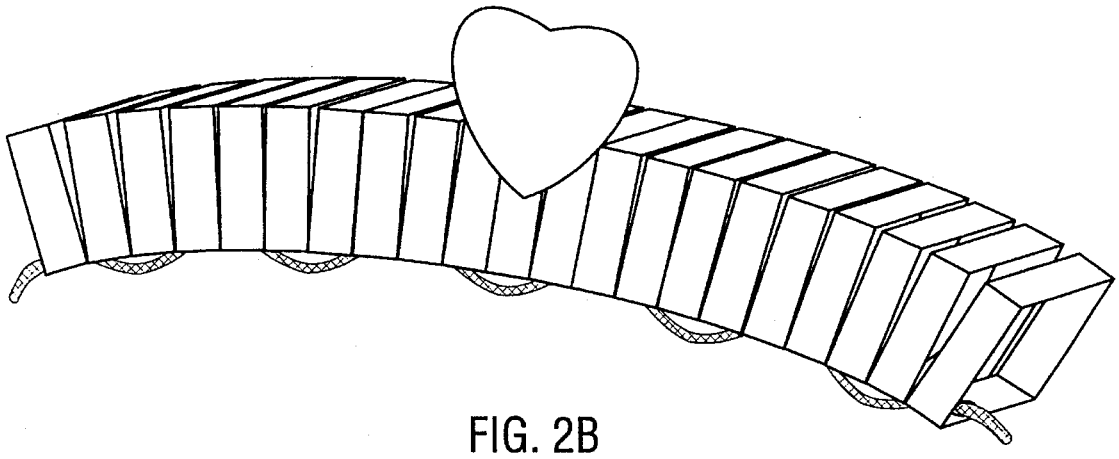
Figure 3B:
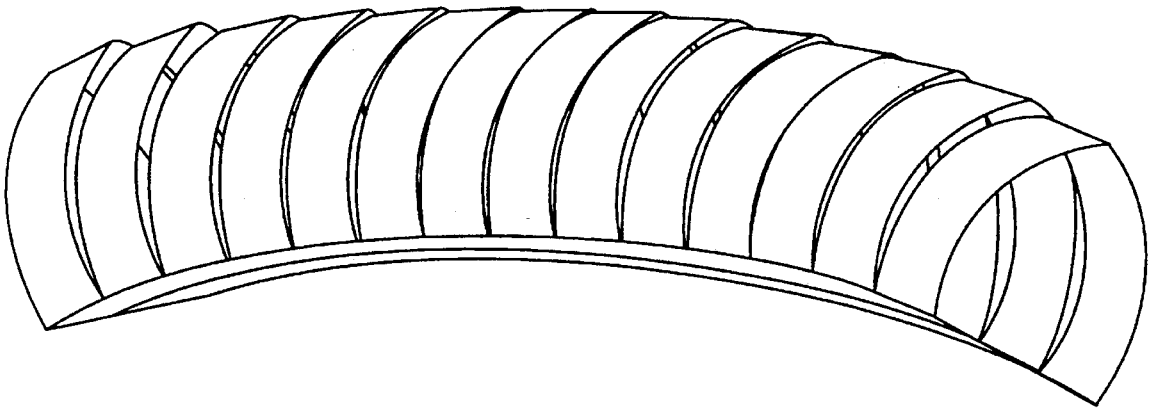

The construction of the placard 10 of the present invention is relatively simple. First, the placard 10 is separated from the rest of sheet 21, if such a sheet is used. Then the opposing edges 46 and 48 are brought together and folds are made along any serrations to produce a three dimensional "tube" of varying cross-sectional configurations. For example, for the placard 10 of FIG. 1A, the cross-sectional configuration will be triangular as illustrated in FIG. 1B. The cross-sectional configuration of the placard 10' in FIG. 2A will be rectangular as illustrated in FIG. 2B. FIG. 3B illustrates the cross-sectional configuration of the placard in FIG. 3A. In the embodiment where holes rather than adhesive strips 47 and 49 are used, ribbon or string may be used to hold the opposing edges together as illustrated in FIG. 2B.

Figure 6C:
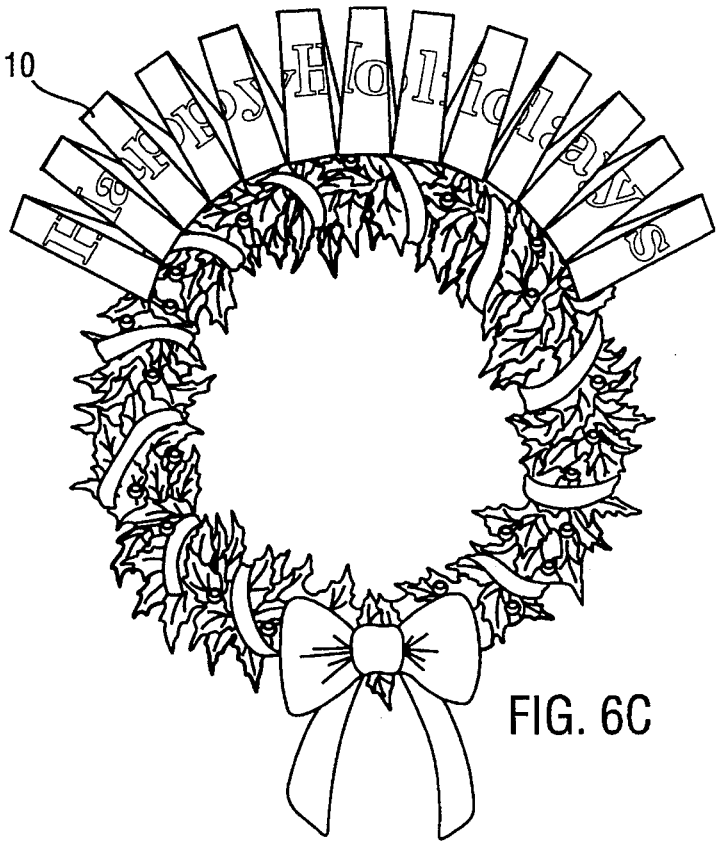
FIGS. 6A–6C illustrate the placard of the present invention as applied to a basket, a stuffed animal and a wreath.
Figure 6A:
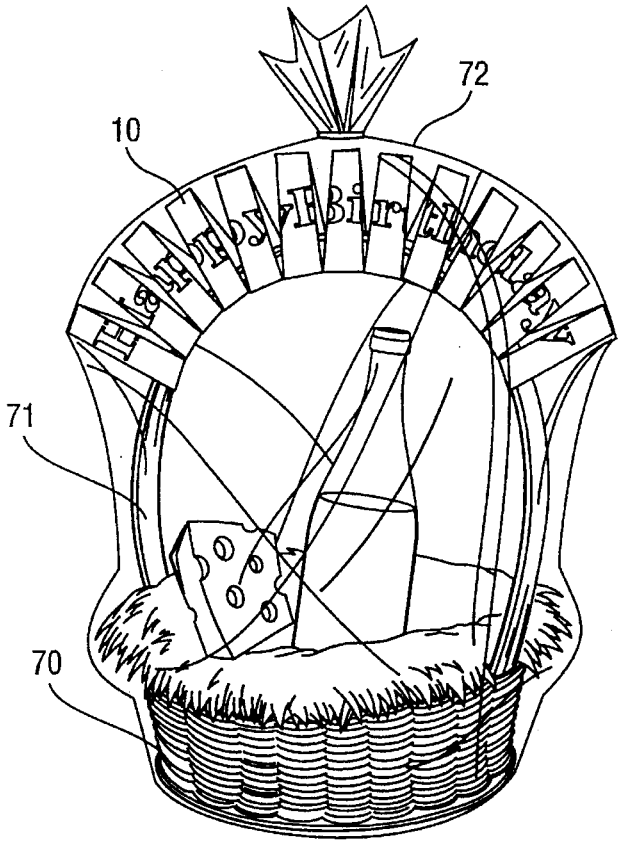

Once the placard 10 of the present invention is formed, it may be placed onto the basket or container. FIG. 6A illustrates the placard of the present invention as applied to the handle 71 of basket 70. Adhesive 49 ensures that placard 10 remains fixed to handle 71. Alternately ribbons or string may be used to affix the placard 10 to the handle 71. The basket 70 and its contents may then be covered with a shrink-wrap material 72 or the like to further hold placard 10 in place.

Figure 6B:
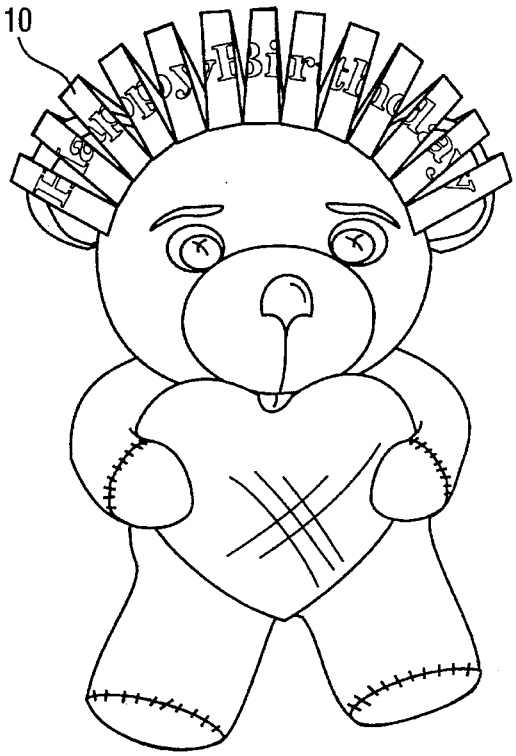

The placard 10 of the present invention may also be placed on any container or handle that includes non-straight edges. For example, FIG. 6B illustrates the placard of the present invention affixed to a circular object, such as a basketball, stuffed animal or the like. FIG. 6C illustrates the placard 10 of the present invention affixed to a wreath.

Figure 7:
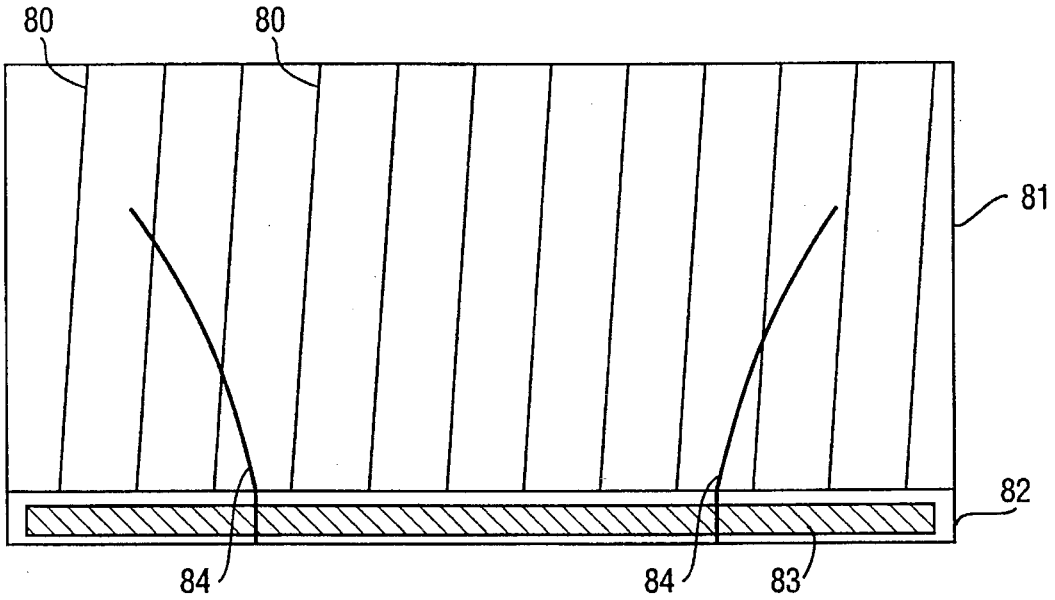
FIG. 7 illustrates a no-fold embodiment of the flexible placard of the present invention.

An alternate embodiment of the placard 10 of the present invention is illustrated in FIG. 7. In this embodiment, no folding assembly of the placard is required. In this embodiment slits 80 are formed along a sheet of material 81. The slits 80 do not extend across the entire length of the material 81 such that a continuous edge 82 is formed. The slits are preferable formed and spaced in a manner similar to that discussed above for the folding embodiment of the present invention. Printed information may be applied to one or both sides of the sheet 80. Adhesive 83 may be applied for affixing the placard to a basket or other container. Small Wires 84 may also be used to help position the portion of the placard upon which the printed information is located.

Figure 8A:
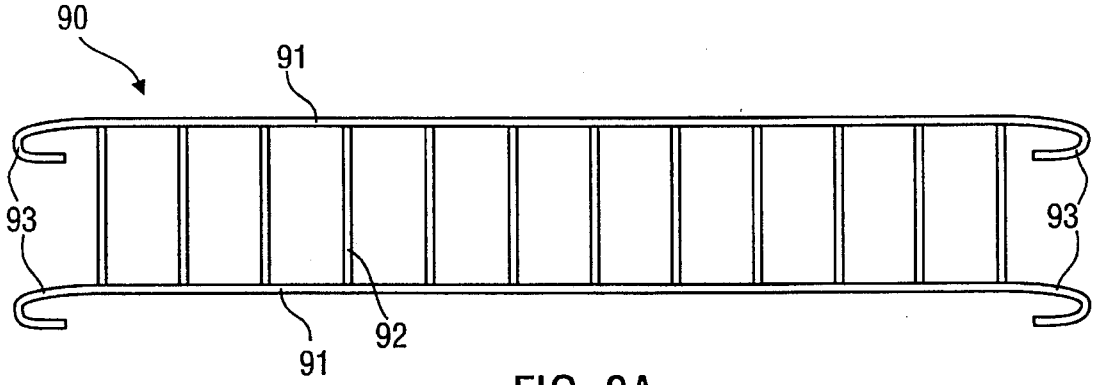
FIGS. 8A–8C illustrate a frame for use with the placard of the present invention.
Figure 8C:
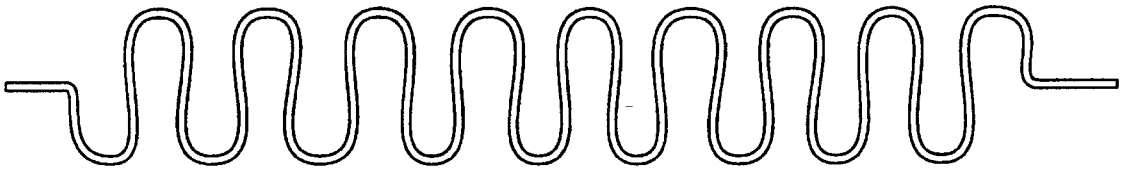
Figure 8B:
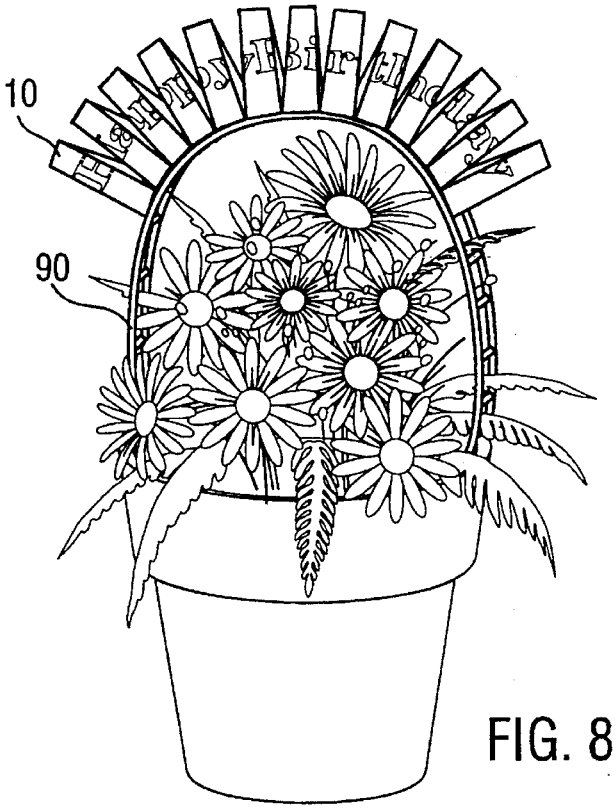

The placard 10 of the present invention may be used with flower pots, flower arrangements, and other containers that do not have curved handles or the like through the use of a frame 90, formed of wire or other bendable material. Such a frame 90 is illustrated in FIG. 8A. In one embodiment, two pieces of wire 91, along with cross pieces 92, form a ladder-like structure. The ends of the wires 91 are curved to form hooks 94. The hooks can then be inserted into portions of the foam, dirt or other material in the handle-less container to form a frame to which the curved placard of the present invention may be attached. FIG. 8B illustrates a flower arrangement 96 where a flexible placard of the present invention 10 is affixed to a frame 90. Alternate embodiments of frame 90 are envisioned. For example, FIG. 8C illustrates and embodiment where the frame 90 is formed from a single curved piece of wire.

Figure 9A:
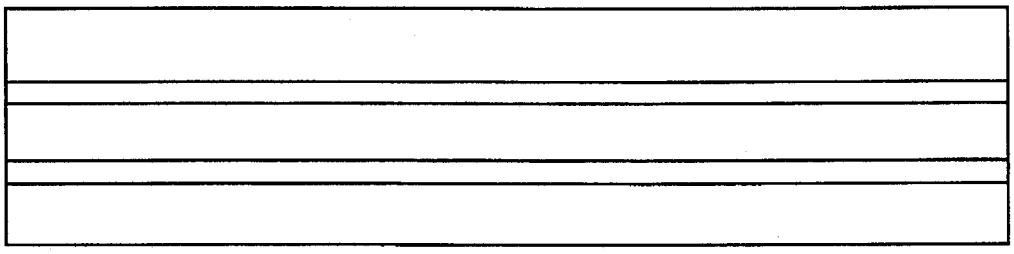
Figure 9B:
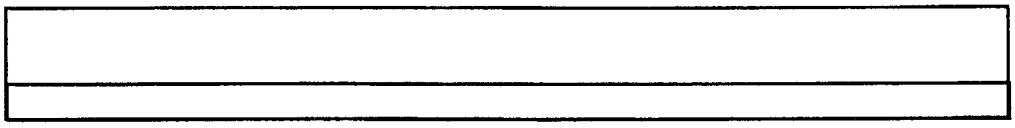
Figure 9C:
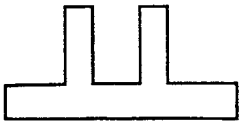

A still further embodiment of the present invention is illustrated in FIGS. 9A–9C. It is embodiment a flexible T-shaped channel 100 is formed of foam, injection molded plastic or other suitable material. FIG. 9A illustrates the top view of this embodiment, FIG. 9B the side view and FIG. 9C the end view. The flexible channel may be affixed to a basket handle or other curved object through the use of adhesive, ribbon or other suitable fastening means. Cutouts, letters, gift card, photographs and the like may be inserted into the flexible channel.

While the invention has been shown and is described with references to the embodiments illustrated in the Figures, it will be understood by those skilled in the art that changes and variations can be made without departing from the spirit or scope of the invention.

I claim as my invention:

1. A flexible placard for a curved object comprising:

a sheet of material, portions of the sheet defining spaced slits extending across a portion of the sheet, wherein information is imprinted on the sheet; and first and second continuous edges extending across first and second sides of the sheet, the slits extending approximately from the first continuous edge to approximately the second continuous edge, wherein the sheet includes a midpoint, each slit spans an angle, and where the angle spanned by a slit located near the midpoint is greater than the angle spanned by a slit located distant from the midpoint.

* * * * *